United States Patent [19]

Conti

[11] 4,387,818

[45] Jun. 14, 1983

[54] SNAP-ON TAMPER-PROOF CLOSURE

[75] Inventor: Vincent N. Conti, West Hempstead, N.Y.

[73] Assignee: Itnoc Dairy Cap Co. Inc., Jamaica, N.Y.

[21] Appl. No.: 204,858

[22] Filed: Nov. 7, 1980

[51] Int. Cl.[3] ..... B65D 41/46

[52] U.S. Cl. ..... 215/256; 215/31; 215/320

[58] Field of Search ..... 215/256; 220/270, 276

[56] References Cited

U.S. PATENT DOCUMENTS

| | | | |
|---|---|---|---|
| 3,073,472 | 1/1963 | Williams | 215/256 |
| 3,109,547 | 11/1963 | Wood . | |
| 3,174,453 | 3/1965 | Strong . | |
| 3,204,799 | 9/1965 | Hunter et al. . | |
| 3,263,724 | 8/1966 | Mojonnier et al. . | |
| 3,298,415 | 1/1967 | Klygis . | |
| 3,464,575 | 9/1969 | Arslanian et al. . | |
| 3,622,028 | 11/1971 | Lohrer . | |
| 3,767,076 | 10/1973 | Kennedy . | |
| 3,940,004 | 2/1976 | Faulstich | 215/256 |
| 3,980,195 | 9/1976 | Fillmore | 215/256 |
| 3,991,904 | 11/1976 | Davis et al. | 215/256 X |
| 3,994,409 | 11/1976 | Nightengale, Jr. | 215/256 |
| 4,066,182 | 1/1978 | Allen et al. | 215/256 |
| 4,162,736 | 7/1979 | Faulstich | 215/256 |
| 4,166,552 | 9/1979 | Faulstich | 215/256 |
| 4,244,479 | 1/1981 | Smalley | 215/256 |

*Primary Examiner*—Donald F. Norton

*Attorney, Agent, or Firm*—Pennie & Edmonds

[57] ABSTRACT

A snap-on closure for use with a bottle having a neck and a mouth defining an opening in communication with the interior of the bottle, includes a circular top wall which contacts the uppermost surface portion of the bottle mouth. A first annular sealing wall, extending centrally downwardly from the top wall, engages and seals an inner surface portion of the bottle mouth. A second annular sealing wall also extending centrally downwardly from the top wall is spaced radially outwardly from the first annular sealing wall and engages and seals an outer surface portion of the bottle mouth. An outer wall, connected to the periphery of the top wall by a thin web membrane to permit easy separation from the top wall, extends downwardly from the periphery of the top wall a greater length than the second annular sealing wall. The outer wall has a flange extending radially outwardly from and along a major portion of its lower edge. The flange cooperates with a shoulder on the bottle neck so as to provide a flush fit with the bottle. A tear tab is connected to the outer wall to facilitate the separation of the outer wall from the top wall. In an alternative embodiment, the outer wall is frangibly connected to the lower periphery of the second annular sealing wall.

10 Claims, 6 Drawing Figures

SNAP-ON TAMPER-PROOF CLOSURE

TECHNICAL FIELD

The present invention relates to a closure device and in particular to a plastic tamper proof snap-on cap for sealing the mouth of a plastic container.

BACKGROUND ART

It is well known to use plastic or metal caps to seal either glass or plastic containers having typical wall and mouth configurations. In particular, with glass bottles, it has been necessary to design the cap with relatively rigid internal sealing configurations so as to accomodate the imperfections typically found in the mouth of glass bottles as a result of the manufacturing process or rough handling thereafter.

In order to provide for improved sealing characteristics, caps have been constructed with internal threads which cooperate with like threads formed on the outer surface of the mouth of the container. Nevertheless, the sealing provided by such threads is not adequate for most uses. Such threaded configuration also not only renders the construction of the cap more difficult but increases the cost of construction as well.

However, removing the threads thereby also removes some of the sealing surfaces. For this reason, it is desirable to compensate for such sealing loss.

Additionally, it is desirable to render the cap tamper-proof so as to be able to discourage or give evidence of any unauthorized removal or prying off of the cap. For this reason, skirts are usually provided about the lower edge of the cap to provide an added feature of security. Such frangible skirts are disclosed in U.S. Pat. Nos. 3,109,547; 3,622,028; 3,940,004; 3,991,904; 3,994,409; 4,066,182; 4,162,736; and 4,166,552.

Before the cap can be removed from the mouth of the container which is sealed by the cap, it is necessary to first separate the skirt from the cap before proceeding with the removal of the cap. Typically, these skirts extend downwardly away from the lower edge of the cap. Inspection of the integrity of the skirt will readily indicate whether unauthorized removal of the cap may have occurred. Such unauthorized removal may be attempted by inserting a fingernail or other suitable implement such as the edge of a screwdriver under the edge of the cap. If such prying is attempted, the skirt usually will break away from the edge of the cap and thus serve as an indication of the tampering.

Notwithstanding the improvements offered by the closure caps disclosed in the above-noted patents, certain of these closure caps suffer from certain disadvantage in that it is possible to pry off the cap and frangible skirt together in one motion without causing any damage or separation of the skirt from the major portion of the cap itself. Additionally, the structure of these caps is such that inadvertent prying off of the cap or separation of the skirt from the remaining portion of the cap may occur when any protruding portion of the skirt is caught by nearby objects.

I have invented a snap-on cap, which together with a container having a suitably configured mouth, provides an improved sealing of the container mouth in combination with the inner sealing characteristics of the snap-on tamper proof closure cap. In addition, I have invented a tamper proof cap which assures relatively more positive identification of intentional or inadvertent prying of the cap off the container. Also, the tamper proof cap which I have invented discourages such intentional prying and furthermore safeguards against inadvertent prying.

DISCLOSURE OF THE INVENTION

The present invention relates to a snap-on cap for use with a container having a neck and a mouth defining an opening communicating with the interior of the container, the neck having an annular ring extending therearound and positioned below the mouth, comprising a top wall configured and dimensioned such that at least a portion of said top wall is capable of contacting at least a first outer surface portion of the container mouth so as to seal the container mouth, a first annular sealing wall extending downwardly from the top wall, the first annular sealing wall having an outer configuration capable of sealingly engaging at least an inner surface portion of the container mouth, a second annular sealing wall extending downwardly from the top wall and being spaced radially outwardly from the first annular sealing wall, the second annular sealing wall having an inner configuration capable of sealingly engaging at least a second outer surface portion of the container mouth, and an outer wall extending downwardly from the periphery of the top wall a greater length than the second annular sealing wall, the outer wall being easily separable from the top wall so as to provide evidence of unauthorized tampering with the snap-on cap.

In a preferred embodiment of the present invention a plastic snap-on cap for use with a container having a neck and a mouth extending therefrom and defining an opening communicating with the interior of the container, the neck having an annular ring extending therearound and positioned below the mouth, the mouth having means for retaining the snap-on cap thereon, comprises a top wall having a diameter greater than that of the container mouth so as to permit the undersurface of the top wall to contact a first outer surface portion of the container mouth so as to seal the container mouth when the cap is positioned atop the container, a first annular sealing wall extending centrally downnwardly from the top wall, the first annular sealing wall having an outer configuration capable of sealingly engaging an inner surface portion of the container mouth, a second annular sealing wall extending centrally downwardly from the top wall and being disposed radially outwardly from the first annular sealing wall, the second annular sealing wall having an inner configuration capable of sealingly engaging the mouth retaining means, and an outer wall connected to the periphery of the top wall and extending downwardly therefrom a greater length than the second annular sealing wall so as to contact the container neck when the cap is positioned atop the container, the outer wall being easily separable from the top wall so as to provide evidence of unauthorized tampering with the snap-on cap.

The first annular sealing wall has a ledge projecting radially outwardly of its outer configuration. The first sealing wall ledge is positioned from the undersurface of the top wall such that the container mouth sealingly engages the first sealing wall ledge when the cap is positioned atop the container. Similarly, the second annular sealing wall has a ledge projecting radially inwardly of its inner configuration. The second sealing wall ledge is positioned from the undersurface of the top wall such that the second outer surface portion of the container mouth engages the first sealing wall ledge when the cap is positioned atop the container.

The outer wall includes a flange extending generally radially outwardly along a major portion of the lower periphery of the outer wall such that a minor portion of the lower periphery of the outer wall is free of the flange. The outer wall flange has a configuration so as to be in a closely contiguous relationship with the upper surface of the annular neck ring when the cap is positioned atop the container.

The cap further includes a tear tab which is connected to the outer wall along a surface portion thereof in a direction generally transverse to the top wall. The tear tab extends therefrom and is spaced apart, preferably uniformly, from the outer wall. The tear tab is positioned so as to be adjacent the minor portion of the lower periphery of the outer wall. Preferably, the tear tab is of a generally rectangular configuration and is connected to the outer wall along one widthwise edge.

The outer wall also includes a score line adjacent the connection of said tear tab to the outer wall and extending in a direction generally transverse to the top wall the height of the outer wall so as to facilitate the separation of the outer wall from the cap. Preferably, the cap is integrally formed of a plastic composition.

In an alternate preferred embodiment, the outer wall is connected to the periphery of the second annular sealing wall and extends downwardly therefrom a length suitable so as to permit the second annular sealing wall to contact the container neck when the cap is positioned atop the container. Additionally, the radial outer surface of the outer configuration of the first annular sealing wall has a generally convex shape with the maximum diameter thereof being greater than the inner diameter of the container mouth.

BRIEF DESCRIPTION OF THE DRAWINGS

The present invention is described in detail below with reference to the drawings wherein.

BEST MODE FOR CARRYING OUT THE INVENTION

In the description which follows, any reference to either orientation or direction is intended primarily for the purpose of illustration and is not intended in any way as a limitation of the scope of the present invention.

Figure 1:
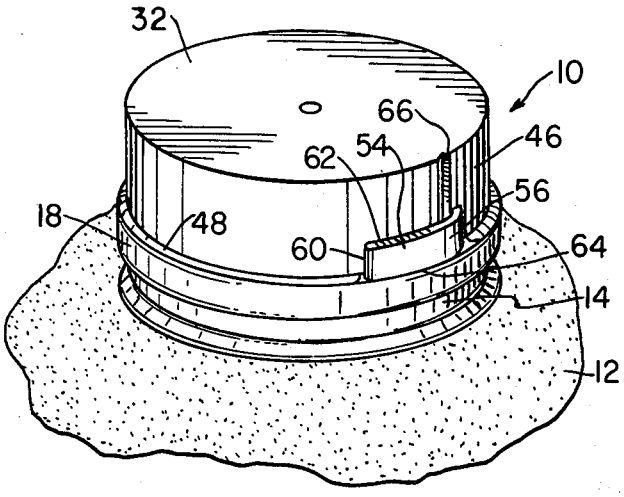
FIG. 1 is a perspective view of a first embodiment of a snap-on tamper proof cap positioned over the neck and mouth of a plastic container in accordance with the present invention.

Referring to the drawings, a snap on closure cap 10 is illustrated in FIG. 1 positioned in secure relationship atop a container such as a bottle 12. The bottle 12 has a cylindrical neck portion 14 and a cylindrical mouth portion 16 which are more clearly illustrated in FIG. 2. The neck 14 has an annular ring 18 having a larger diameter than the remaining portions of the neck 14. The mouth 16 has a smaller diameter than the neck 14 and defines an opening which communicates with the interior 20 of the bottle 12.

Figure 5:
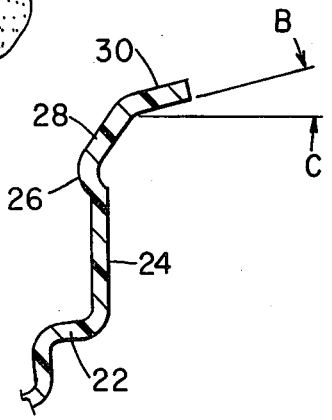
FIG. 5 is a cross-sectional view of a portion of the mouth of the plastic container of FIG. 2 in a normal condition without any snap-on tamper proof cap thereon.

As shown more clearly in FIG. 5 the mouth 16 extends upwardly from the neck 14 and includes in sequence therefrom a horizontal ledge 22, a vertical wall 24, a retaining ridge 26, a first sloped wall member 28 and a second sloped wall member 30. The periphery of the second sloped wall member 30 defines the opening of the bottle 12. The first sloped wall member 28 preferably forms normally, i.e., without the snap on cap 10 in place, an angle of approximately 30 degrees with the vertical axis of the bottle 12 represented by the arrow "A" in FIG. 2. The second sloped wall member 30 preferably forms normally an angle of approximately 15 degrees relative to a direction transverse to the vertical axis of bottle 12 as indicated in FIG. 5 between the arrows "B–C".

The bottle 12 preferably is formed of a deformable material such as plastic which permits the first and second sloped wall members 28, 30 of mouth 16 to be resilient. This permits the second sloped wall member 30 to flex from its position as illustrated in FIG. 5 in a so-called "normal" condition toward the horizontal to that shown in FIG. 2 upon application of the cap 10 to the bottle 12. In addition, the first sloped wall member 28 flexes slightly inwardly toward the horizontal as well. Such flexure of the first and second sloped wall member 28, 30 of bottle 12 provides for improved sealing which will be described in greater detail below.

Figure 2:
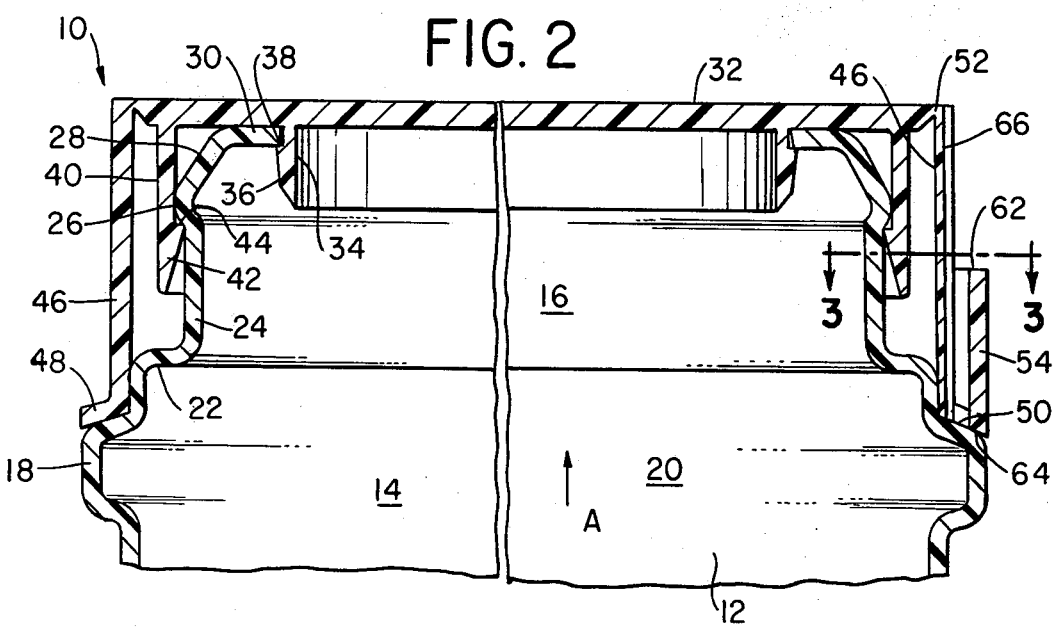
FIG. 2 is cross-sectional view of the snap-on tamper proof cap atop a plastic container taken along the line 2—2 of FIG. 1.

Referring now to FIG. 2, the cap 10 includes a circular top wall 32 having a diameter greater than the opening of the mouth 32. Additionally, the top wall has a diameter approximately equal to the diameter of the neck 14.

A first annular sealing wall 34 having a circular configuration extends downwardly and centrally of the undersurface of top wall 32. The outer diameter of the first annular sealing wall 34 is of a dimension sufficient to permit sealing engagement with the periphery of second sloped wall member 30 upon attachment of cap 10 to bottle 12. An outwardly extending protrusion 36 results in a ledge or shoulder 38, the purpose of which will be more fully described below.

A second annular sealing wall 40 also extends downwardly and centrally of the undersurface of top wall 32 and is spaced outwardly of the first annular sealing wall 34. The inner diameter of the second annular sealing wall 40 is approximately equal to that of the retaining ridge 26 of mouth 16. An outwardly extending protrusion 42 results in a ledge or shoulder 44 similar to shoulder 38.

A pull ring 46 is attached to the outer periphery of top wall 32 and extends downwardly therefrom to an outwardly extending flange 48 positioned about a major portion of the periphery of pull ring 46. The height of pull ring 46 is sufficient so that the flange 48 of pull ring 46 is positioned in a snug fit relation atop the upper surface or shoulder 50 of annular ring 18. In addition, the flange 48 has an undersurface contour which conforms with the uppersurface contour of shoulder 50. The flange 48 extends outwardly to a length approximately equal to the length of shoulder 50 to permit a flush fit between the flange 48 and shoulder 50. The pull ring 46 is connected to the periphery of top wall 32 by a thin membrane 52 which permits easy breakage of pull ring 46 from top wall 32 upon pulling or drawing of the flange 48 of pull ring 46 away from the bottle 12. The snug and flush fit relationship between the flange 48 and shoulder 50 avoids the inadvertant separation of the pull ring 40 from bottle 12 until such time as separation is desired.

Figure 3:
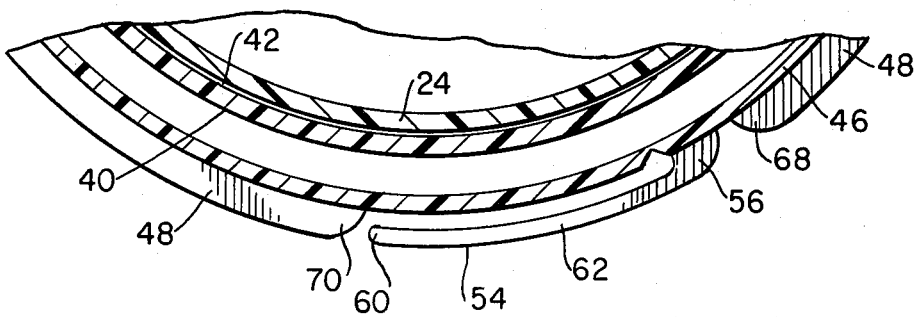
FIG. 3 is a cross-sectional view of the snap-on tamper proof cap atop a plastic container taken along the line 3—3 of FIG. 2 illustrating a tear away tab.
Figure 4:
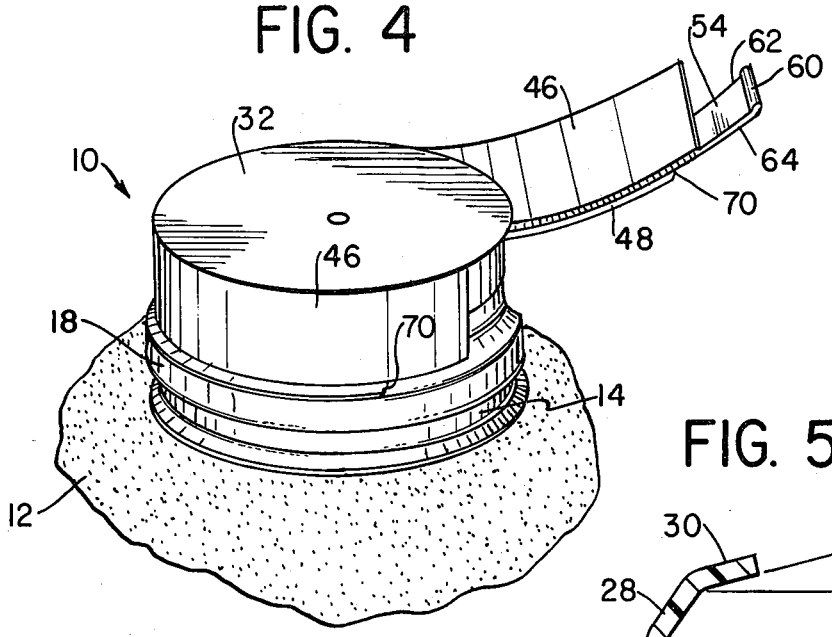
FIG. 4 is a perspective view of the snap-on tamper proof cap atop a plastic container in FIG. 1 illustrating the tear away tab and outer wall in a partially removed condition.

To facilitate the removal of pull ring 46, a pull ring tab 54 is positioned as shown in FIGS. 1–3. The pull ring tab 54 is of a rectangular shape and has a height less than that of pull ring 46. The pull ring tab 54, as shown in FIG. 1, is attached at one side edge 56 which is of a thicker construction than the rest of the pull ring tab 54 to a portion 58 of the pull ring 46. The other side edge 60 is free of pull ring 46 to permit insertion of a thumb nail or finger nail to facilitate removal of pull ring 46. In addition, the upper edge 62 and lower edge 64 of pull ring tab 54 are also free of pull ring 46. As in the case with the pull ring 40, the pull ring tab 54 has a height sufficient so that the lower edge 64 rests atop the shoulder 50 of annular ring 18. In addition, the pull ring tab 54 by means of its one side edge 56 is spaced from the pull ring 46 no further than the outer periphery of flange 48. To further facilitate removal of the pull ring 46, a scoreline 66 is provided vertically along the outer surface of pull ring 46 adjacent and before the connection of pull ring 54 by the thicker side edge 56 to the pull ring 46. As shown in FIG. 3, the pull ring 46 at its one side edge 56 having a thicker construction is adjacent one free end 68 of flange 48. The other side edge 60 of pull ring tab 54 is situated in spaced relationship from the other free end 70 of flange 48. Accordingly, the pull ring tab 54 does not overlie any portion of the flange 48 but rather is positioned within the minor portion of the periphery of pull ring 46 which is free of any flange construction.

In a preferred embodiment, the flange 48 has an outwardly downwardly sloping configuration corresponding to a similar configured shoulder 50 of annular ring 18. This permits the flange 48 to rest snugly upon the shoulder 50 in a flush configuration around the major portion of the periphery of pull ring 46. Likewise, the lower edge 64 of pull ring tab 54 also has a sloping configuration corresponding as well to that of shoulder 50 of annular ring 18.

Upon application of the cap 10 to the bottle 12, the cap 10 passes over the mouth 16 in a manner so that the first annular sealing wall 34 flexes inwardly as it passes over the periphery of the second sloping wall member 30 which in turn flexes downwardly toward the horizontal. After the second sloping wall member 30 passes the protrusion 36, it finally falls into position and is securely maintained between shoulder 38 and the undersurface of the top wall 32. Similarly, the second annular sealing wall 40 flexes outwardly as it passes over the retaining ridge 26. After the retaining ridge 26 passes over the protrusion 42, it finally falls into position and is securely maintained on shoulder 44. When cap 10 is finally in place atop bottle 12, the undersurface of top wall 32 contacts the upper surface of first sloping wall member 30. To facilitate in the sealing of the mouth 16, the shoulder 38 is spaced from the undersurface of top wall 32 approximately the thickness of the first sloping wall member 30. In addition, the shoulder 44 is spaced from the under surface of top wall 32 a distance approximately equal to the distance between the retaining ridge 26 from the top surface of first sloping wall member 30 when in a flexed condition as shown in FIG. 2.

In operation, after the cap 10 is secured to the bottle 12 by means known to those skilled in the art, cap 10 will remain in a fixed position atop the bottle 12. In the event of any unauthorized tampering with the cap 10, the pull ring 46 will separate at membrane 52 from the top wall 32 and thereby provide an indication of an unauthorized attempt to remove the cap 10 from the bottle 12. Also, inasmuch as the pull ring 46 is separate from and not directly connected to either sealing flanges 34 or 42 an unauthorized party attempting to remove the cap would not be aware of this particular construction. Therefore, such unauthorized party would be careless in presuming that no tamper proof ring such as pull ring 46 would in fact be present. This would make the unauthorized party less cautious and would not induce him to gently remove the cap in an attempt to avoid breakage of a tamper ring if such were evidently provided. In addition, even if an unauthorized party knew of the pull ring 46 serving as a tamper-proof ring, the construction of the pull ring 46 apart from either sealing flange 34 or 40 permits the pull ring 46 to be more readily removed from the cap 10 in the event of an unauthorized attempt to remove the cap 10 from the bottle 12. Also, the relatively greater length of pull ring 46 from the top wall 32 provides a greater leverage arm which makes breakage or separation of pull ring 46 from the cap 10 easier to accomplish. Moreover, the flush arrangement of flange 48 atop the shoulder 50 of annular ring 18 helps to avoid inadvertent separation of the pull ring 46 from the remaining portions of cap 10.

Figure 6:
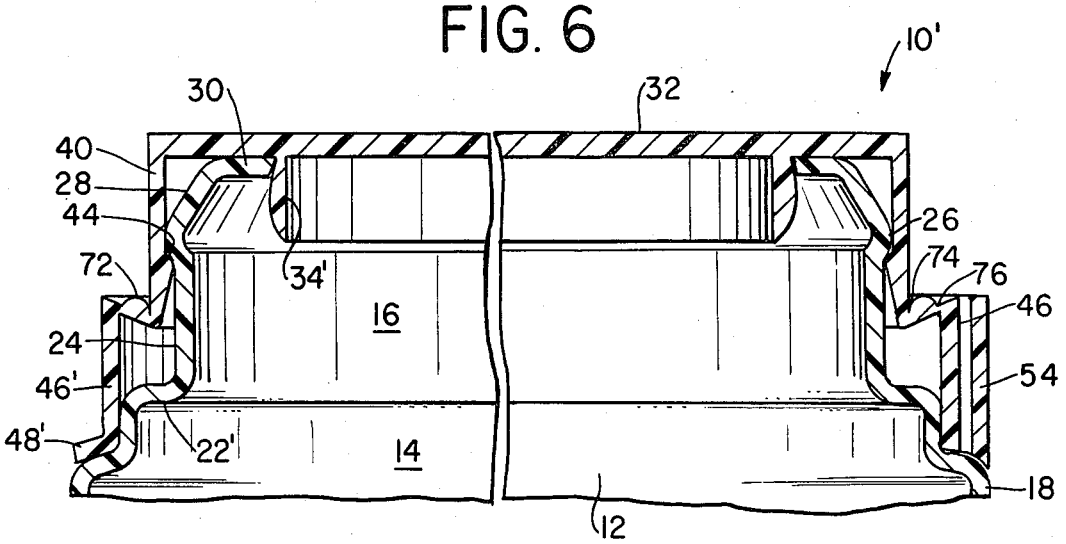
FIG. 6 is a cross-sectional view of a second embodiment of a snap-on tamper proof can positioned over the neck and mouth of a plastic container in accordance with the present invention.

An alternate embodiment of the cap 10' according to the present invention is illustrated in FIG. 6. Structural features identical to those in the embodiment described above are identified by like numbers while features similar to those in the above-described embodiment are identified by like-primed numbers. Accordingly, no further detailed description with respect to these features is believed necessary. The first annular sealing wall 34' has a radially convex shaped outer surface which provides for securement and sealing of the periphery of the second sloping wall member 30. The pull ring 46' is connected to periphery of the second annular sealing wall 40 by a ring 72 having a thinner construction at its connection 74 to the second annular sealing wall 40 and at its connection 76 to the upper periphery of pull ring 46'. Such thinner construction at 74 and 76 provides for easy separation of the pull ring 46' from the cap 10'.

Thus, the caps 10 and 10' as snap-on caps provide for a reduction of material typically required in construction of such caps employing threads for securement and sealing to a bottle 12. Moreover, the sealing structure of the snap-on caps 10 and 10' provide improved fluidtight sealing of the mouth of the bottle 12.

I claim:

1. A snap-on cap for use with a container having a neck and a mouth defining an upper opening communicating with the interior of the container, the neck having an annular ring extending therearound and positioned below the mouth, comprising:

(a) a top wall configured and diminished such that at least a portion of said top wall is capable of contacting at least an uppermost outer surface portion of said container mouth so as to seal the container mouth;

(b) a first annular sealing wall extending downwardly from said top wall, said first annular sealing wall having an outer configuration capable of snap-fitting sealing engagement with at least an inner surface portion of the container mouth;

(c) a second annular sealing wall extending downwardly from said top wall and being spaced radially outwardly from said first annular sealing wall and inwardly from the periphery of said top wall, said second annular sealing wall having an inner configuration capable of snap-fitting sealing engagement with at least an outer surface portion of the container mouth; and (d) an outer wall extending downwardly from the periphery of said top wall a greater length than said second annular sealing wall, said outer wall being easily separable from said top wall so as to provide evidence of unauthorized tampering with said snap-on cap.

2. A plastic snap-on cap for use with a container having a neck and a mouth extending thereform and defining an upper opening communicating with the interior of the container, the neck having an annular ring extending therearound and positioned below the mouth, the mouth having means for retaining the snap-on cap thereon, comprising:

(a) a generally circular top wall having a diameter greater than that of the container mouth so as to permit the undersurface of said top wall to contact an uppermost outer surface portion of said container mouth so as to seal the container mouth when said cap is positioned in snap-fitting relationship atop the container;

(b) a first annular sealing wall extending centrally downwardly from said top wall, said first annular sealing wall having an outer configuration capable of snap-fitting sealing engagement with an inner surface portion of the container mouth;

(c) a second annular sealing wall extending centrally downwardly from said top wall and being disposed radially outwardly from said first annular sealing wall and inwardly from the periphery of said top wall, said second annular sealing wall having an inner configuration capable of snap-fitting sealing engagement with the mouth retaining means; and (d) an outer wall connected to the periphery of said top wall and extending downwardly therefrom a greater length than said second annular sealing wall so as to contact the container neck when the cap is positioned atop the container, said outer wall being easily separable from said top wall so as to provide evidence of unauthorized tampering with said snap-on cap.

3. The cap according to claim 2 wherein said first annular sealing wall has a ledge projecting radially outwardly of said outer configuration, said first sealing wall ledge being positioned from said undersurface of said top wall such that the container mouth sealingly engages said first sealing wall ledge when said cap is positioned atop the container.

4. The cap according to claim 3 wherein said second annular sealing wall has a ledge projecting radially inwardly of said inner configuration, said second sealing wall ledge being positioned from said undersurface of said top wall such that the mouth retaining means sealingly engages said second sealing wall ledge when said cap is positioned atop the container.

5. The cap according to claim 4 wherein said outer wall includes a flange extending generally radially outwardly along a major portion of the lower periphery of said outer wall such that a minor portion of the lower periphery of said outer wall is free of said flange, said outer wall flange having a configuration so as to be in a closely contiguous relationship with the upper surface of said annular neck ring when said cap is positioned atop the container.

6. The cap according to claim 5 further including a tear tab connected to said outer wall along a surface portion thereof in a direction generally transverse to said top wall, said tear tab extending therefrom uniformly spaced apart from said outer wall.

7. The cap according to claim 6 wherein said tear tab is positioned so as to be adjacent said minor portion of the lower periphery of said outer wall.

8. The cap according to claim 7 wherein said tear tab is of a generally rectangular configuration and is connected to said outer wall along one widthwise edge.

9. The cap according to claim 8 wherein said outer wall includes a score line adjacent the connection of said tear tab to said outer wall and extending in a direction generally transverse to said top wall the height of said outer wall so as to facilitate the separation of said outer wall from said cap.

10. The cap according to claim 9 wherein said cap is integrally formed of a plastic composition.

* * * * *